US005407556A

United States Patent [19]

Shimada et al.

[11] Patent Number: 5,407,556

[45] Date of Patent: Apr. 18, 1995

[54] PROCESS OF PRODUCING METALLIC FOIL BY ELECTROLYSIS

[75] Inventors: Makoto Shimada; Takayuki Shimamune; Yasuo Nakajima, all of Tokyo, Japan

[73] Assignee: Permelec Electrode Ltd., Kanagawa, Japan

[21] Appl. No.: 151,197

[22] Filed: Nov. 12, 1993

[30] Foreign Application Priority Data

Nov. 11, 1992 [JP] Japan ..... 4-300935

[51] Int. Cl.[6] ..... C25D 1/04

[52] U.S. Cl. ..... 205/77; 205/76; 205/239; 205/292

[58] Field of Search ..... 205/76, 77, 292, 239–242

[56] References Cited

U.S. PATENT DOCUMENTS 3,880,728 4/1975 Habermann et al. ..... 204/38 A
4,437,948 3/1984 Okinaka et al. ..... 205/292
4,913,973 4/1990 Geusic ..... 428/469

FOREIGN PATENT DOCUMENTS 0215649 3/1987 European Pat. Off. ..... C25D 17/10

OTHER PUBLICATIONS

Patent Abstracts of Japan, vol. 11, No. 184, Jun. 12, 1987.

*Primary Examiner*—John Nieling
*Assistant Examiner*—William T. Leader
*Attorney, Agent, or Firm*—Sughrue, Mion, Zinn, Macpeak & Seas

[57] ABSTRACT

A process of producing a metallic foil by electrolysis by depositing the metallic foil on a cathode by electrolysis from a sulfuric acid acidic solution is disclosed, which comprises using an electrode having a coating of an electrode active material containing a platinum group metal oxide as an anode and carrying out the electrolysis in an electrolyte containing from 1 to 20 ppm of a lead component when a fluorine component does not exist in the electrolyte or an electrolyte containing from 0.2 to 1 ppm of a fluorine component and from 0.1 to 20 ppm of a lead component when a fluorine component exists in the electrolyte. The life of the electrode can be prolonged and a metallic foil can be stably produced by electrolysis for a long period of time by preventing the lead component(s) derived from the raw material from mixing into the metallic foil.

4 Claims, 2 Drawing Sheets

FIG. 1
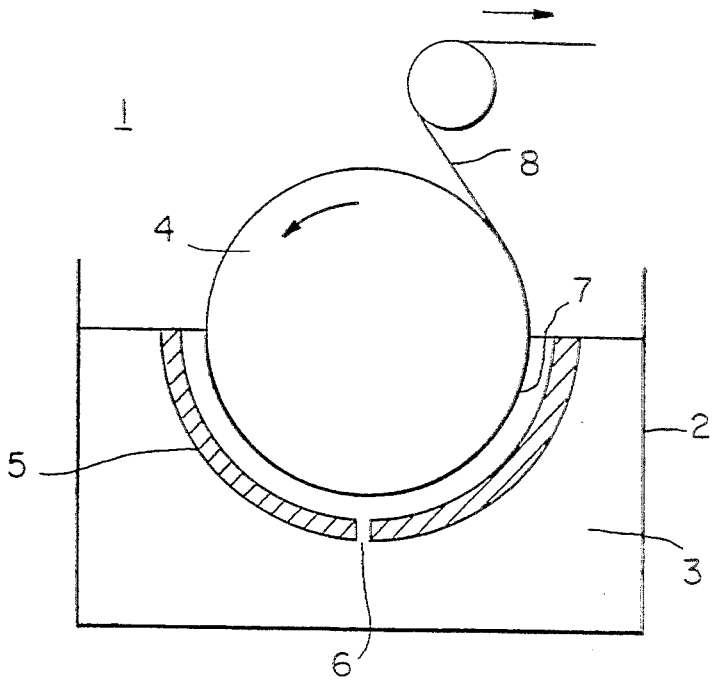
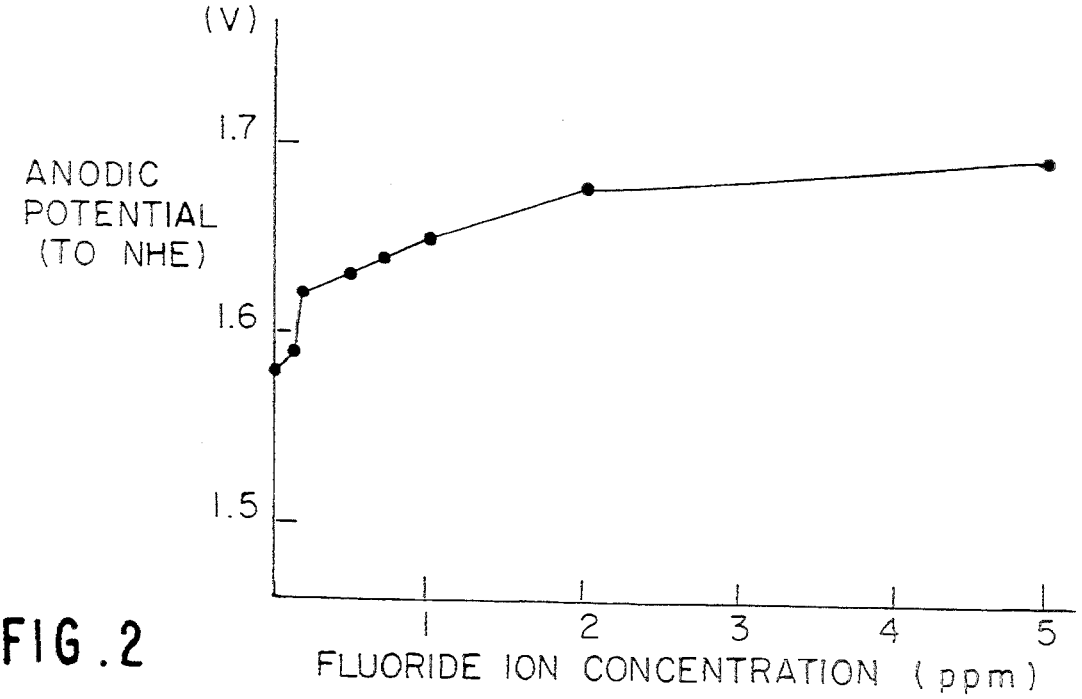
FIG. 2

PROCESS OF PRODUCING METALLIC FOIL BY ELECTROLYSIS

FIELD OF THE INVENTION

The present invention relates to a continuous electrolytic production process of a metallic foil such as a copper foil, etc., which is mainly used for a printing circuit board, etc.

BACKGROUND OF THE INVENTION

As the production process of a metallic foil, there are various processes according to the quality of the materials and the uses of the metallic foil being produced but a process of producing a metallic foil by rolling and a process of producing a metallic foil by electrolysis are typical.

Copper foils which are used for printing plate boards for electric circuits are almost always produced by electrolysis. This is because in the case of an electrolytic copper foil, even when an inexpensive scrap copper, etc., is used as the raw material, the purity of the metallic copper deposited is improved by the principle of the electrolytic refining, and also the copper foil having a uniform thickness over a wide area can be easily obtained.

Furthermore, the texture of a metal deposited by electrolysis is suitable for the purpose of forming an electric circuit and has the feature of easily applying etching having a large aspect ratio. Also, another reason for the production by electrolysis being typical is that the cost for the metallic foil produced is lower than that of a metallic foil produced by rolling.

As shown in FIG. 1 of the accompanying drawings as the cross sectional view of an example of a copper foil producing apparatus by electrolysis, an electric current is passed through a large electrode roller 4 the lower portion of which is immersed in an electrolyte 3 in an electrolytic tank 2 as a cathode and an insoluble anode 5 as a counter electrode and while continuously plating copper on the surface of the cathode roller by supplying an electrolyte from an electrolyte-supplying slit 6 of the anode 5, the metallic copper 7 deposited is continuously scraped from the surface of the cathode roller as a copper foil. This process has the features that the average thickness of the copper foil 8 obtained can be easily controlled by controlling the amount of the electric current supplied and also a thin copper foil can be easily formed.

The electrolytic copper foil being used widely is continuously produced initially by a process of using a lead alloy as an anode, electrolytically depositing copper on the surface of a drum-type cathode made of lead, and winding the deposited copper foil while scraping the copper foil from the surface of the cathode. However, although the lead alloy anode is said to be insoluble, the consuming speed of the anode is very high as about several mg/Ah. Also, with the consumption of the anode, lead is dissolved in a sulfuric acid acidic copper sulfate solution as the electrolyte but since the solubility of lead is less in sulfuric acid, lead exists in the electrolyte as the insoluble particles of copper sulfate. As the result-thereof, it frequently happens that the particles of lead sulfate is intermixed in the copper foil obtained by electrolysis as if the particles were dispersed in the foil, and give bad influences on the copper foil. In particular, this is a large problem in the production of a thin copper foil having a thickness of not thicker than 25 μm.

In order to remove the lead component from the electrolyte, a process of adding strontium carbonate, etc., to the electrolyte to co-precipitating the lead component and separating the precipitates by filtration is carried out but since the foregoing process is not a process of preventing the dissolution itself of the lead alloy electrode, the contamination of the electrolyte caused by the successively occurring dissolution of the lead alloy electrode can not be prevented. Also, as the result of the dissolution of the anode, there appears a problem that the distance between the cathode and the anode can not be maintained at a constant distance for a long period of time, and also there occurs a problem that the electrolytic tank and the electrolyte must be frequently repaired.

Furthermore, for solving the problem of the dissolution of the lead alloy anode, an insoluble metal electrode formed by coating a substrate of a thin film-forming metal such as titanium, a titanium alloy, etc., with an electrode active material containing a platinum group metal or the metal oxide has been used as the anode as disclosed in U.S. Pat. No. 4,318,794. The consumption of the insoluble metal electrode by the dissolution of the electrode material is from 1 to 0.1 mg/kAh or lower, which is from about 1/1,000 to 1/10,000 of the consumption of a lead alloy, and thus substantially no contamination of the electrolyte and the metallic foil as the product by the dissolution of the electrode occurs.

Also, such an insoluble metal electrode is very stable and can be continuously used almost as it is for several thousands hours. Furthermore, the deterioration of the electrode is not, in many cases, the deterioration of the electrode active material but occurs by the formation of a passive oxide film between the electrode substrate and the electrode active material.

SUMMARY OF THE INVENTION

The object of the present invention is to provide an electrolytic production process of a metallic foil, wherein the life of the electrode (anode) can be prolonged and also a metallic foil can be stably produced by electrolysis for a long period of time by preventing the lead component(s) mixed in the electrolytic bath from the raw material of the metal such as scrap copper, etc, from mixing in the metallic foil formed as the particles, etc., of lead sulfate.

As the result of various investigations, it has been found that the foregoing object can be achieved by the present invention as set forth hereinbelow.

That is, according to the present invention, there is provided a process of continuously producing a metallic foil by electrolysis by depositing a metal on a cathode in an electrolytic bath composed of a sulfuric acid acidic solution, which comprises using an insoluble metal electrode having an electrode active material containing a platinum group metal oxide as an anode and an electrolyte containing from 1 to 20 ppm of a lead component or an electrolyte containing from 0.1 to 20 ppm of a lead component and from 0.2 to 1 ppm of a fluorine component.

That is, when a metallic foil is produced by electrolysis using an electrolyte containing lead dissolved therein, lead dioxide is deposited on the surface of the coating composed of the electrode active material containing the platinum group metal oxide as the anode. Also, it has been discovered that if the thickness of lead dioxide is about several tens μm, even when the coating of lead dioxide is formed, the electric potential of the anode is far lower than the electric potential of lead dioxide and is kept at an electric potential very near the original electrode potential of the active coating containing the platinum group metal oxide, and when a lead component exists in the electrolyte, there is a possibility that lead dioxide is continuously supplemented during the electrolysis, and the present invention has been accomplished based On the discovery.

BRIEF DESCRIPTION OF THE DRAWINGS

FIG. 1 is a schematic cross sectional view showing an example of an apparatus of producing a copper foil by electrolysis, FIG. 2 is a graph showing the relation of the fluorine concentration in the electrolyte and the anodic potential.

DETAILED DESCRIPTION OF THE INVENTION

Figure 3:
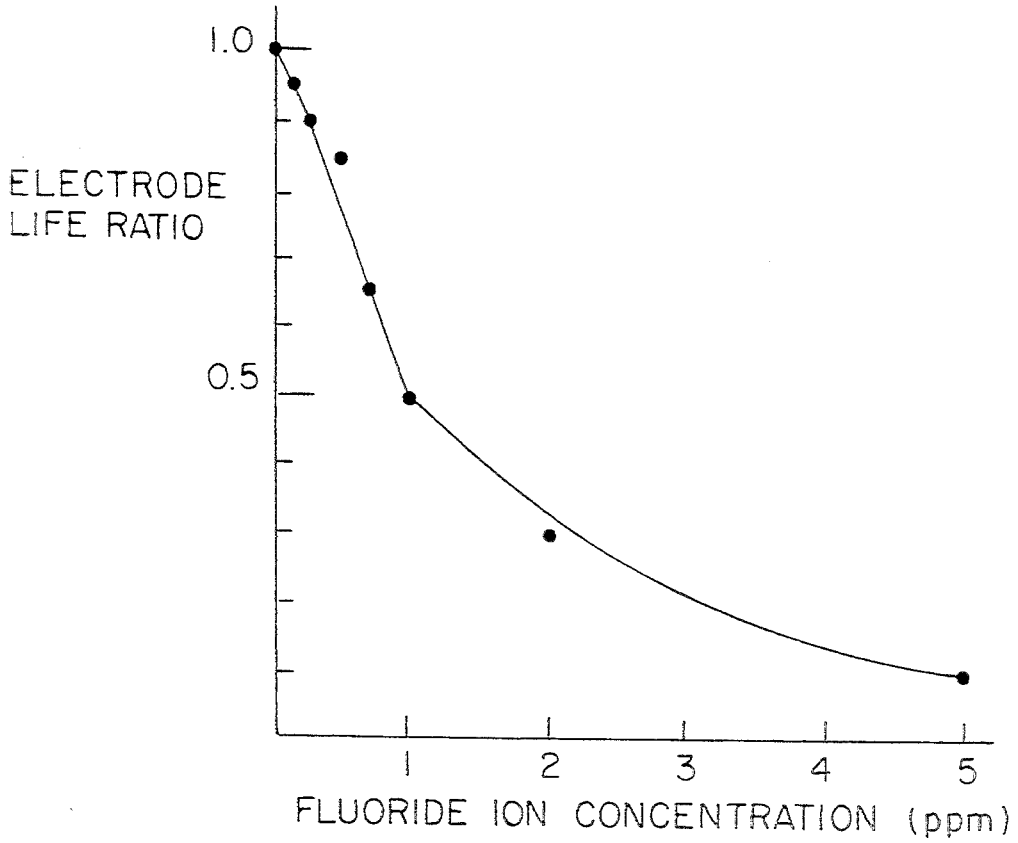
FIG. 3 is a graph showing the relation of the fluorine concentration in the electrolyte and the life of the electrode.

Then, the present invention is described in detail.

The oxygen generating electric potential of an insoluble metal electrode having a platinum group metal oxide being used for the electrolytic production of a metallic foil is about 1.6 volts to the standard hydrogen electrode which is the equilibrium potential for forming lead dioxide from lead sulfate but as the case may be, the lead compound formed at the electric potential forms an unstable compound according to the electrolytic condition and lead dioxide is not always stably formed on the surface of the anode.

However, when the concentration of the lead component in the electrolyte is adjusted to be a definite value, lead dioxide is stably deposited on the surface of the anode and also lead dioxide thus deposited on the surface of the anode functions as an anode, which results in prolonging the life of the anode.

It is considered that the lead component in the electrolyte is deposited on the surface of the anode as lead sulfate and thereafter lead sulfate is oxidized into lead dioxide, which stably functions as an anode.

It is preferred that the content of the lead component existing in the electrolyte is from 1 to 20 ppm. If the content of the lead component is less than 1 ppm, the depositing speed of lead dioxide deposited on the surface of the anode is low, and stable lead dioxide is not deposited on the surface of the anode, whereby a sufficient effect is not obtained. Also, if the content thereof is over 20 ppm, the particles of lead sulfate are formed, floated in the electrolyte, and are taken and dispersed in the metallic foil formed, which undesirably results in the deterioration of the performance of the metallic foil.

When the content of the lead component in the metal component which is dissolved in the electrolyte as the raw material for the metallic foil is less, a lead compound may be added to the electrolyte or metallic lead may be added to the electrolyte and dissolved therein. Also, the existing form of the lead component in the electrolyte may be a lead ion or may be other form.

Also, when the electrolyte contains a fluoride ion or an atomic group containing fluorine, the oxygen generating electric potential of the anode is increased. When such an electrolyte contains a lead component, the deposition of stable lead dioxide easily occurs. In this case, even when the electrolyte has low concentration of the lead component as compared with the electrolyte containing no fluorine component, the above-mentioned effect can be obtained, that is, if the fluorine component is present in the electrolyte, the effect can be obtained on the condition that the content of the lead component is in the range of from 0.1 to 20 ppm. It is preferred that the concentration of the fluorine component in the electrolyte is from 0.2 to 1 ppm.

Examples of the fluorine component capable of being used in the present invention include $F^-$, $BF_4^-$, $SiF_6^-$, etc., and a compound forming such an ion may be added to the electrolyte.

On the other hand, even when a fluorine component exists in the electrolyte, it does not give influences on the metallic foil deposited on the surface of the cathode but since a fluorine component corrodes titanium being used as the electrode (cathode) substrate, it is preferred that the concentration of the fluorine component is not more than 1 ppm. Also, if the concentration of the fluorine component is less than 0.2 ppm, the effect of increasing the formation of lead dioxide is lowered.

Furthermore, the anode having the electrode active coating containing a platinum group metal oxide, said anode having lead dioxide formed on the surface of the anode, keeps the same electric potential of the anode having no lead dioxide formed thereon. Since lead dioxide has a large corrosion resistance to organic materials, etc., added to the electrolyte for improving the properties of the metallic foil, lead dioxide formed on the surface of the anode largely contributes to prolong the life of the anode.

Also, as the electrode active material of the anode, iridium forming the stable oxide thereof is preferably used. By coating the anode with the composite oxide of iridium and tantalum, etc., the anodic potential can be stabilized and the consumption of the anode can be reduced. Furthermore, since the surface crystal phase of the composite oxide is of a rutle type, the formation of lead dioxide on the surface becomes easy and also has a feature that stable lead dioxide is obtained.

Various kinds of oxygen impermeable layers can be formed on the thin film-forming metal substrate such as titanium being used as the electrode substrate of the anode but, in particular, a semiconductive composite oxide of titanium and tantalum is preferred and further platinum may be added to the oxide system.

In the present invention, in the process of producing a metallic foil by electrolysis by depositing a metal from an electrolytic bath on the cathode using the insoluble metal electrode having the electrode active material containing the platinum group metal oxide as the anode, by carrying out the electrolysis using the electrolyte containing from 1 to 20 ppm of a lead component or the electrolyte containing from 0.1 to 20 ppm of a lead component and from 0.2 to 1 ppm of a fluorine component, whereby a stable lead dioxide layer is formed on the electrode active coating containing the platinum group metal oxide from the electrolyte, whereby the life of the anode is prolonged and also the occurrence of the deterioration of the properties of the metallic foil caused by mixing of a lead component into the metallic foil from the electrolyte is prevented.

Then, the invention is described practically by the following examples.

EXAMPLE 1

To a solution containing copper sulfate at a concentration of 200 g/liter and sulfuric acid at a concentration of 130 g/liter was added gelatin corresponding to 4 ppm to the weight of the solution to provide an electrolyte.

As a cathode, a titanium drum having a diameter of 200 mm was used and a semi-circumferential anode was disposed around the cathode drum with a distance of 10 mm from the surface of the anode.

As the anode, titanium was used as the substrate, an oxygen impermeable layer of 0.2 μm composed of platinum was formed on the surface thereof, and further the coating of the electrode active material composed of the composite oxide of iridium and tantalum at a molar ratio of Ir:Ta=70:30 was formed thereon by a thermal decomposition method.

The single electrode potential of the anode showed 1.58 volts to the standard hydrogen electrode in sulfuric acid of 150 g/liter and at 60° C. and a current density of 20 amperes/dm$^2$ and was not influenced by platinum formed as the oxygen impermeable layer.

Then, the plural electrolytic apparatus each having the construction described above were prepared, the concentration of lead in each electrolyte in each apparatus was changed, the electrolysis was continuously carried out in each electrolytic apparatus at a current density of 60 amperes/dm$^2$ and an electrolyte temperature of 45° C. while keeping each constant concentration of the copper component by supplementing the copper ion reduced by the electrolysis, and the state of the deposit on each anode after 1,000 hours of the electrolysis was shown in Table 1.

TABLE 1

| Concentration of Lead (ppm) | State of Deposit on Each Anode |
|---|---|
| 0 | No deposit |
| 0.5 | No deposit |
| 1 | White deposit |
| 5 | White deposit |
| 10 | White and dark brown deposit |
| 20 | White and dark brown deposit |
| 30 | White and dark brown deposit |

As shown in Table 1, when the concentration of lead is from 1 to 20 ppm, the deposition of lead is seen on the surface of the anode, in particular, when the concentration thereof is from 10 to 20 ppm, lead dioxide is deposited to function as the electrode (anode), and also, when the concentration is from 1 to 5 ppm and the electrolysis is further carried out for 1,000 hours, about a half of white lead sulfate deposited is conversed to lead dioxide, which functions as an anodic material.

Also, when the electrolysis was carried out using the electrolytes each having a lead concentration of 1 and 5 ppm, the electrolysis could be carried out for 10,000 hours with the electrolyte having a lead concentration of 1 ppm and could be carried out for longer than 15,000 hours with the electrolyte having a lead concentration of 5 ppm.

On the other hand, when the electrolyte containing no lead component and the electrolyte containing 0.5 ppm or less of a lead component were used for the electrolysis, lead was not deposited and the life of the anode was 5,000 hours and 6,500 hours, respectively. Also, when the electrolyte containing 30 ppm of a lead component was used, the precipitates of lead sulfate formed in the electrolyte and lead sulfate was deposited in the copper foil obtained.

The life of the anode was defined as the life thereof when the electrolytic voltage was raised one volt with respect to the electrolytic voltage at the beginning of the electrolysis.

EXAMPLE 2

To each of the electrolytes was added sodium silicofluoride ($Na_2SiF_6$) at each different concentration and the electrolysis was carried out by the same manner as Example 1 except that each electrolyte containing the fluorine compound as described above was used.

The relation of the concentration of fluorine in the electrolyte and the electrode potential was shown in FIG. 2. As shown in FIG. 2, when the concentration of fluorine was not lower than 0.2 ppm, the increase of the anodic potential becomes remarkable.

Also, the relation of the concentration of fluorine and the life of the anode was shown in FIG. 3 with the case of adding no fluorine component being designated as 1.

As shown in FIG. 3, when the concentration of fluorine in the electrolyte is over 1 ppm, the life of the anode is suddenly shortened and hence it can be seen that the concentration of fluorine in the electrolyte is preferably from 0.2 to 1 ppm.

Thus, using the electrolyte containing the fluorine compound at a fluorine concentration of 0.8 ppm, the electrolysis was carried out by the same manner as in Example 1 and the state of the deposit on each anode was shown in Table 2 below. In this case, when the fluorine concentration was not lower than 30 ppm, precipitates formed in the electrolyte.

TABLE 2

| Concentration of Lead (ppm) | State of Deposit on Each Anode |
|---|---|
| 0 | No deposit |
| 0.05 | No deposit |
| 0.1 | Light brown deposit |
| 0.5 | Dark brown deposit |
| 1.0 | Dark brown deposit |
| 5.0 | Dark brown deposit |
| 10.0 | Dark brown deposit |
| 20.0 | Dark brown deposit |
| 30.0 | Dark brown deposit |

As described above, according to the process of the present invention, an electrolysis for producing a metallic foil is carried out using the insoluble metal electrode having the electrode active material containing the platinum group metal oxide as the anode in an electrolyte containing from 1 to 20 ppm of a lead component or an electrolyte containing from 0.1 to 20 ppm of a lead component and from 0.2 to 1 ppm of a fluorine component to deposit the lead component in the electrolyte on the anode as a stable lead dioxide layer, whereby the life of the anode is prolonged and also the occurrence of the deterioration of the properties of the metallic foil formed caused by mixing of the lead component into the metallic foil from the electrolyte can be prevented.

While the invention has been described in detailed with reference to specific embodiments, it will be apparent to One skilled in the art that various changes and modifications can be made to the invention without departing from its spirit and scope.

What is claimed is:

1. A process of producing a metallic foil by electrolysis comprising the step of depositing the metallic foil on a cathode by electrolysis in an electrolytic bath comprising a sulfuric acid acidic solution; wherein, an electrode having a coating of an electrode active material containing a platinum group metal oxide is used as an anode; and, the electrolysis is conducted in the electrolytic bath further containing from 0.2 to 1 ppm of a fluorine component and from 0.1 to 20 ppm of a lead component.

2. A process of producing a metallic foil by electrolysis as claimed in claim 1, wherein the platinum group metal oxide contained in the coating of the electrode active material of the anode is iridium oxide.

3. A process of producing a metallic foil by electrolysis as claimed in claim 1, wherein the sulfuric acid acidic solution is a sulfuric acid acidic copper sulfate solution and the metallic foil is a copper foil.

4. A process of producing a metallic foil by electrolysis as claimed in claim 3, wherein the platinum group metal oxide contained in the coating of the electrode active material of the anode is iridium oxide.

* * * * *